United States Patent [19]

Hamilton

[11] Patent Number: 5,008,500

[45] Date of Patent: Apr. 16, 1991

[54] DOCUMENT FEEDER WINDOW CLOSED DETECTION ASSEMBLY

[75] Inventor: T. A. Hamilton, Fife, Scotland

[73] Assignee: Unisys Corporation, Blue Bell, Pa.

[21] Appl. No.: 525,454

[22] Filed: May 18, 1990

[30] Foreign Application Priority Data

May 31, 1989 [GB] United Kingdom ..... 8912426

[51] Int. Cl.[5] ..... H01H 3/16

[52] U.S. Cl. ..... 200/61.7; 200/332

[58] Field of Search ..... 200/52 R, 61.41, 61.42, 200/61.58 R, 61.62, 61.7, 61.84, 329-332, 573

[56] References Cited

U.S. PATENT DOCUMENTS 4,264,793 4/1981 Mailloux ..... 200/61.7 X 4,277,657 7/1981 Kleinschmidt et al. ..... 200/61.7 X

*Primary Examiner*—J. R. Scott

*Attorney, Agent, or Firm*—Whitham & Marhoefer

[57] ABSTRACT

The invention relates to a system for detecting the open or closed state of a hinged window (14) in a wall (11) of a document track. The state of the window is sensed by a micro-switch (22) operated by a lever (21). The lever has one arm (31) which operates the plunger of the micro-switch and another arm (33) which senses the position of the window relative to the wall (11). When the window is open, the spring loading on the micro-switch plunger (37) acts on the arm (31) to rotate the lever (21) clockwise with respect to the window frame. When the window is closed, engagement between the wall (11) and the front face (38) of a projection (34) on the lever arm (33) rotates the lever anticlockwise relative to the window frame so that the projection (32) on the lever arm (31) depresses the micro-switch plunger against the spring loading.

7 Claims, 3 Drawing Sheets

DOCUMENT FEEDER WINDOW CLOSED DETECTION ASSEMBLY

BACKGROUND OF THE INVENTION

Field of the Invention

This invention relates to a system for detecting the open or closed state of a hinged window in an equipment wall. The term "window" is used herein to denote not only a glazed panel, but also any panel which is used to open and close an opening in a wall.

In many pieces of equipment in which a window is provided to open and close an opening in a wall, it is necessary to provide a signal indicating whether the window is open or closed. In many cases it is necessary that the closure of the window should be monitored accurately since, for example, if the "window closed" signal is given before the window is completely closed, malfunctioning of the equipment may occur, or harm may be done to the operator.

It is therefore an object of the present invention to provide a monitoring system which can be made to provide a "window closed" signal only when the window is either completely closed or within a very small distance from the completely closed position.

Most monitoring systems of the kind to which the invention is applicable include a micro-switch which is operated when the window is closed. To obtain accurate monitoring of the closure of the window it is desirable that the micro-switch should be mounted on the movable window assembly, which term window assembly as used herein includes the window and its frame, is mounted as far away as possible from the hinge axis of the window assembly. This means, for example, that in the case of a window which pivots about a horizontal axis at the lower edge of the window the micro-switch would have to be mounted in the region of the upper edge of the window. In such an arrangement the micro-switch plunger would have to engage the equipment wall in such a way that the plunger is depressed by the wall when the window is closed. An arrangement of this kind is frequently impossible for constructional reasons, or at least undesirable for aesthetic reasons.

In cases in which the switch cannot be satisfactorily mounted on the upper edge of the window it has to be mounted in some other position, and a mechanism has to be provided to sense movement between the upper edge of the window and the equipment wall and then transmit this movement to the micro-switch. Most attempts at providing a mechanism of this kind have involved catering for multiple manufacturing tolerances between a number of different components. As a result of these tolerances a system of this kind would entail adjusting the switch position on each individual piece of equipment for satisfactory operation. Arrangements of this kind are therefore normally unacceptable.

SUMMARY OF THE INVENTION

In accordance with the invention the micro-switch is mounted on an extension of the movable frame which supports the window, and a lever is mounted for rotation on the window frame hinge axis. One arm of the lever includes a portion adapted to engage the plunger of the micro-switch while the other arm of the lever includes a portion adapted to engage the equipment wall at a point remote from the hinge axis. The arrangement is such that, when the window is open, the spring loading on the micro-switch plunger, acting on said one arm of the lever, tends to rotate the lever in a first direction relative to the window and its frame. When the window is closed, engagement between the wall and said other arm of the lever rotates the lever relative to the window and its frame in the direction opposite to said first direction so that said one arm of the lever operates the micro-switch by depressing the plunger against the spring loading.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
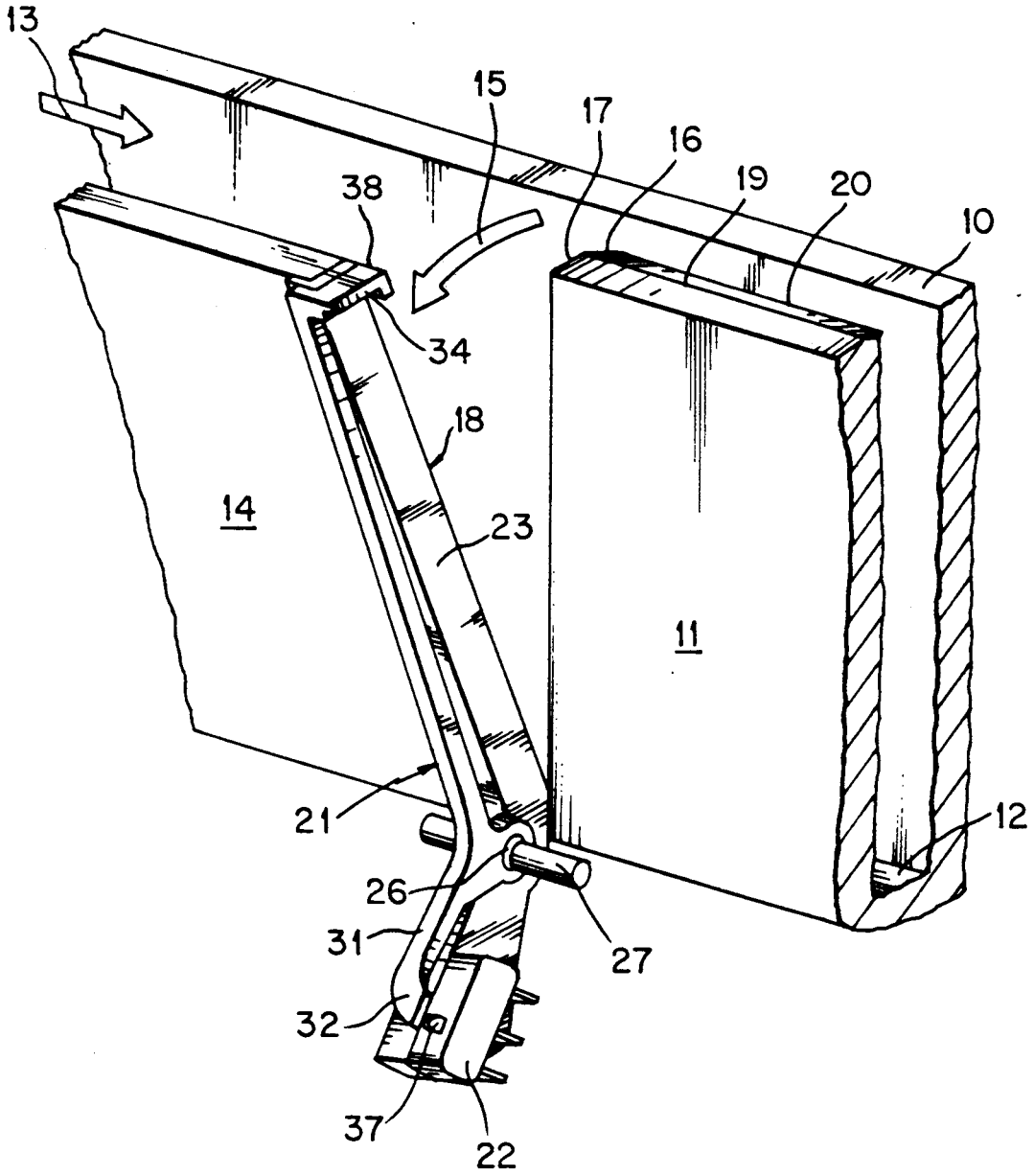
FIG. 1 is a perspective view of a document path with a window partially open.

FIG. 1 illustrates a document path comprising a rear wall 10, a front wall 11, and a base 12. Documents are driven along the path in the direction of the arrow 13 by means not shown. To provide access to the path, which may be required for example if a document becomes jammed in the path, a window assembly 14 is provided. When the window assembly 14 is opened by pivoting it downwardly in the direction of the arrow 15, the document feed system is halted. When the window assembly is reclosed, the feed system is restarted. To provide reliable operation of the system it is necessary that the feed system should not be started until the window assembly is within a very short distance of being completely closed and the invention therefore provides means for detecting accurately when the window assembly is sufficiently closed for the feed system to be restarted.

The edge of the wall 11 adjacent to the window assembly 14 is provided with a chamfer 16 to deflect a document back into the path if its leading edge should strike the edge of the wall. However, if a document were to strike the unchamfered part of the edge 17 a jam would occur. Accordingly it is essential that the feed system should not restart until the edge 18 of the window assembly has reached the beginning of the chamfer 16. The junction between the chamfered portion 16 and the unchamfered portion 17 is more particularly indicated by a line 19 drawn on the top of the front wall 11, and it will be seen that the feed must be restarted when the edge 18 of the window assembly lies between the line 19 and the inner face 20 of the wall 11.

Figure 2:
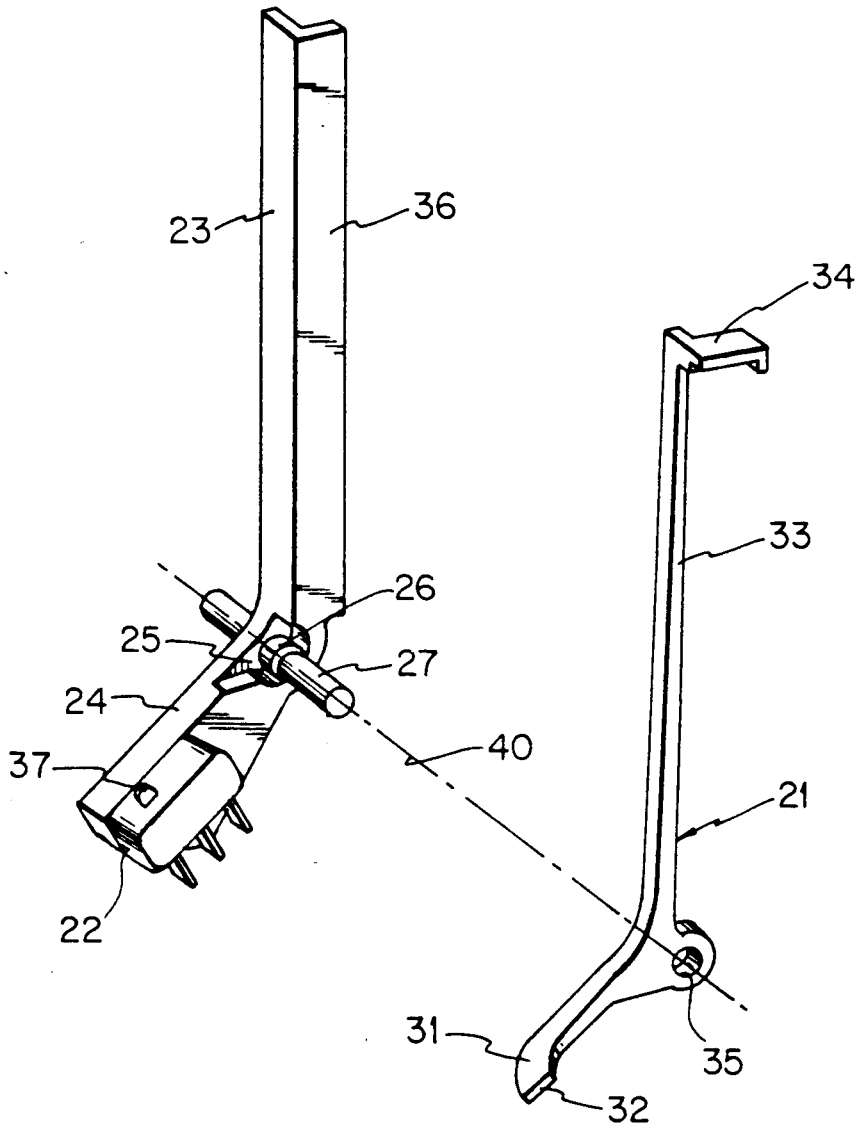
FIG. 2 is an exploded view of part of the detection system illustrated in FIG. 1.
Figure 3:
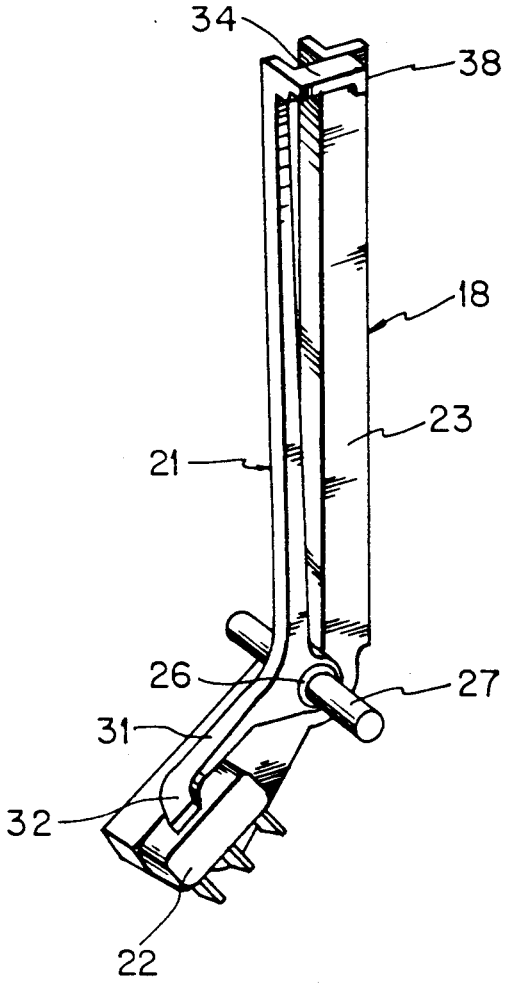
FIG. 3 shows the parts illustrated in FIG. 2 assembled and in the relative positions produced when the window is closed.

The means provided in accordance with the invention for detecting that the edge 18 is between the lines 19 and 20 comprises a lever 21 and a micro-switch 22. A side 23 of the window frame in which the window panel is mounted is provided with an extension 24 on which the micro-switch 22 is mounted. A portion of the frame 23 for the window is cut away as indicated at 25 in FIG. 2, and a boss 26 is fixed to the frame on the axis of the hinge pin 27 through which runs the window assembly hinge axis 40.

The lever 21 comprises a first arm 31 having a projection 32, and a second arm 33 having a projection 34.

The lever 21 is provided with a bearing surface 35 which fits on the boss 26.

When the lever 21 is mounted on the boss 26, the outer face of the arm 33 is substantially coplanar with the outer edge 36 of the window frame member 23. When the window assembly is open, as shown in FIG. 1, the plunger 37 of the micro-switch 22 rotates the lever 21 clockwise with respect to the window assembly so that the forward edge 38 of the projection 34 is level with the forward edge 18 of the frame member 23. Under these conditions the spring loading on the plunger will have forced the plunger into the position in which the switch contacts are open.

When the window is closed, the forward edge 38 of the projection 34 engages the front face of the wall 11 and as the window assembly is pushed further towards the fully closed position this engagement rotates the lever 21 anticlockwise with respect to the window frame extension 24 since the window frame continues to move as the window is pushed toward its fully closed position. As a result the projection 32 on the lever arm 31 depresses the plunger 37 of the micro-switch 22. As a result the "window closed" signal is sent to the feed system which is automatically restarted thereby.

The arrangement is such that the switch contacts are not closed until the edge 18 of the window frame is situated between the lines 19 and 20. It will be seen that sensing of the position of the window assembly relative to the wall 11 takes place at the optimum position, i.e. at the top of the window. No manufacturing tolerances need to be taken into account with this design since the only parameter sensed is the relationship of the window to the track wall irrespective of their absolute positions.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A system for detecting the open or closed state of a window assembly in an equipment wall, said window assembly, mounted for rotation about a hinged axis defined by a hinge pin, comprising;

a micro-switch mounted on an extension of the window assembly;

a lever freely mounted for rotation on the window assembly hinge axis, one arm of said lever including a portion adapted to engage a plunger of said micro-switch and another arm of said lever including a portion adapted to engage said equipment wall at a point remote from said hinge axis, the arrangement being such that, when said window assembly is open, the spring loading on said micro-switch plunger, acting on said one arm of said lever, rotates said lever in a first direction relative to said window assembly, and, when the window assembly is closed, engagement between said wall and said other arm of said lever rotates said lever relative to said window assembly in the direction opposite to said first direction so that said one arm of said lever operates said micro-switch by depressing said plunger against said spring loading.

2. A system according to claim 1, wherein said one arm of said lever is shorter than said other arm and extends at an obtuse angle relative thereto.

3. A system according to claim 2, wherein said extension of said window frame extends from the region of the hinge axis at an angle to the plane of the window assembly substantially equal to said obtuse angle.

4. A system according to claim 1, wherein said lever is rotatable on a boss fixed to said window assembly coaxial with the window hinge axis.

5. A system according to claim 4, wherein said window assembly includes a window frame and said boss is located within said window assembly at the junction between said window assembly itself and said window assembly extension so that the outer edge of the other arm of said lever is substantially coplanar with the outer edge of one side of the window frame.

6. A system according to claim 5, wherein said portion of said other arm, which is adapted to engage the equipment wall, extends outwardly from the free end of said other arm and also extends towards said equipment wall for a distance equal to, or greater than, the thickness of said side of the window frame.

7. A system according to claim 6, wherein, when said window assembly is open, the lever is rotated in said first direction relative to said window assembly until the free end of the said other arm of said lever contacts the side of the window assembly, in which position said portion of said other arm projects inwardly of the window assembly whereas, when said window assembly is closed, engagement between the equipment wall and said portion of said other arm rotates the lever in said opposite direction relative to said window assembly until the said portion of said other arm is located in a position spaced from the inner edge of said window assembly by the thickness of said equipment wall.

* * * * *